United States Patent [19]

Tsilibes et al.

[11] Patent Number: 4,740,818

[45] Date of Patent: Apr. 26, 1988

[54] ELECTROPHOTOGRAPHIC REPRODUCTION APPARATUS AND METHOD WITH SELECTIVE SCREENING

[75] Inventors: George N. Tsilibes, Rochester; Pierce B. Day, Pittsford; David E. Hockey, Rochester; Tomas Roztocil, Caledonia; Dale Smith, Hilton; John P. Swapceinski, Bergen; John L. Steeves, Rochester, all of N.Y.

[73] Assignee: Eastman Kodak Company, Rochester, N.Y.

[21] Appl. No.: 940,694

[22] Filed: Dec. 11, 1986

Related U.S. Application Data

[63] Continuation-in-part of Ser. No. 809,548, Dec. 16, 1985, abandoned, and Ser. No. 809,549, Dec. 16, 1985, abandoned.

[51] Int. Cl.[4] ..... G03G 15/04

[52] U.S. Cl. ..... 355/14 R; 355/7; 355/77; 358/283

[58] Field of Search ..... 355/14 E, 14 R, 4, 7, 355/3 R, 77, 67, 71; 430/31, 396, 494; 358/283

[56] References Cited

U.S. PATENT DOCUMENTS

| | | | |
|---|---|---|---|
| 3,523,725 | 8/1970 | Schaeffer | 355/8 |
| 3,615,392 | 10/1971 | Honjo | 96/1.2 |
| 3,936,173 | 2/1976 | Kidd et al. | 355/3 R |
| 4,194,221 | 3/1980 | Stoffel | 358/283 |
| 4,227,795 | 10/1980 | Bobbe et al. | 355/3 R |
| 4,255,040 | 3/1981 | Weigl et al. | 355/3 R |
| 4,403,257 | 7/1982 | Hsieh . | |
| 4,451,137 | 5/1984 | Farley | 355/3 R |
| 4,472,047 | 9/1984 | Stoudt | 355/4 |
| 4,517,579 | 5/1984 | Kitamura . | |
| 4,680,642 | 5/1984 | Shimano et al. . | |
| 4,700,235 | 10/1987 | Gall | 358/283 |
| 4,701,808 | 10/1987 | Nagashima | 358/283 X |

FOREIGN PATENT DOCUMENTS

| | | |
|---|---|---|
| 57-119379 | 7/1982 | Japan . |
| 59-88754 | 5/1984 | Japan . |
| 59-87470 | 5/1984 | Japan . |
| 59-93459 | 8/1984 | Japan . |

*Primary Examiner*—R. L. Moses

*Attorney, Agent, or Firm*—Norman Rushefsky

[57] ABSTRACT

An electrophotographic reproduction apparatus and method are provided for reproducing an original document sheet that includes a continuous tone pictorial information area and a line-type information area. Rather than reproducing the entire document sheet with screening of both types of information, means are provided for selectively screening only the pictorial information area on the reproduction. The means of one preferred embodiment comprises a programmable illumination source that is programmed through inputs by the operator using a digitizing tablet to selectively image portions of a screen onto a charged photoconductive web prior to development of the electrostatic image formed on the web so that only the area on the web receiving the pictorial image is exposed to the screen. In another embodiment the programmable illumination source, such as LED's, modulates the portion of the image frame receiving an optical exposure of the pictorial information with the screen type exposure so that the pictorial information only is reproduced with a screen pattern. In still another embodiment a sensor automatically senses and determines the image portions to be selectively screened.

53 Claims, 8 Drawing Sheets

ELECTROPHOTOGRAPHIC REPRODUCTION APPARATUS AND METHOD WITH SELECTIVE SCREENING

BACKGROUND OF THE INVENTION

Cross Reference to Related Applications

This application is a continuation-in-part of U.S. applications Ser. No. 809,548 filed Dec. 16, 1985, now abandoned and 809,549 filed Dec. 16, 1985, now abandoned.

This application is also related to commonly assigned application Ser. No. 809,550, filed on Dec. 16, 1985 in the names of Michael D. Stoudt et al and entitled, "Apparatus and Method for Electrophotographically Producing Copies From Originals Having Continuous-Tone and Other Content."

FIELD OF THE INVENTION

The present invention relates to electrophotographic reproduction apparatus and methods and, more specifically, to the improved reproduction of originals having both continuous-tone (e.g. pictorials) and other content (e.g. uniform background and/or line-type.

BRIEF DESCRIPTION OF THE PRIOR ART

In U.S. Pat. No. 4,472,047, filed in the name of Michael D. Stoudt and issued Sept. 18, 1984, apparatus and methods are described for producing reproductions from originals having continuous-tone information and other content such as a uniform background and/or line-type information. In reproducing such originals using an electrophotographic reproduction apparatus, it is desirable to reproduce continuous-tone information such as pictorials as half-tone images to reduce the contrast between adjacent areas within each pictorial. In may also be desirable to reproduce other information, such as logos having large printed areas, with a screen to enhance reproductions made therefrom. To accomplish this, the original may be imaged through a half-tone screen onto a preassigned image frame area of an electrostatically charged photoconductive member and the resulting latent image developed with electroscopic toners which are then transferred to a copy sheet. As the pictorial image may only form a portion of the frame area of the photoconductive member, electrostatic charge on the areas of the frame outside the pictorial area (hereinafter referred to as "background" areas) will not be reduced sufficiently to prevent some development from occurring there as well and the resulting copy sheets will appear to have background areas surrounding the pictorial areas which have objectionable density known as "mottling" rather than being "substantially clean." In addition, where line-type information such as alphanumerics, etc. is to be reproduced in the background areas, it is desirable that this image information not be modulated by the halftone screen during the imaging process.

To achieve the above desired result, the aforesaid patent teaches the use of the mounting of one or more continuous tone originals to be reproduced on a transparent support. A first light source positioned in front of the originals is used to illuminate them so that reflected light therefrom, after modulation by a halftone screen, may be imaged on a frame of the photoconductive member.

Where the background areas of the reproduction are to have say line-type information, the aforesaid patent teaches that a second exposure station is to be provided and the line-type information printed on a separate light reflective support. Light-absorbing masks are also mounted on this support in areas corresponding to the continuous-tone originals. After exposure of the frame to the original using illumination from the first light source, the frame is moved to the second exposure station where the frame is exposed to light reflected from the reflective portions of the second support. This has the effect of reducing the levels of charge only in the background areas of the frame except where the line-type information is to be reproduced. The reproduction thus formed using such an apparatus has background areas that are substantially clean with line-type information not modulated by a half-tone screen. However, it will be appreciated that there is a need for mounting continuous tone originals on a special support and in the case of also producing reproductions from originals having mixed content of continuous tone and line-type information, a second exposure station needs to be provided and special effort required to the production and mounting of masks on the second support.

It is, therefore, an object of the invention to provide an electrophotographic reproduction apparatus and method for producing reproductions from originals having both continuous tone and other content and to provide such reproductions without the disadvantages of the apparatus and methods of the prior art, but yet providing such reproductions with the improved contrast obtainable through screening of the continuous tone information of the original, without compromising the image quality of line-type content of the same original.

SUMMARY OF THE INVENTION

This and other objects are accomplished by providing an apparatus and method for electrophotographically producing a reproduction having a half-tone screened image area on a portion of the area thereof by providing signals related to the position of an image area to be screened relative to a reference element; and in response to the signals, a charge modulating means, independent of the imaging light source, forms an electrostatic latent halftone pattern on a portion of an image frame area of the photoconductive member which is to form the reproduction of the half-tone screened image area without the charge modulating means reproducing a screen pattern in other areas of the image frame.

BRIEF DESCRIPTION OF THE DRAWINGS

The subsequent description of the preferred embodiments of the present invention refers to the attached drawings wherein.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
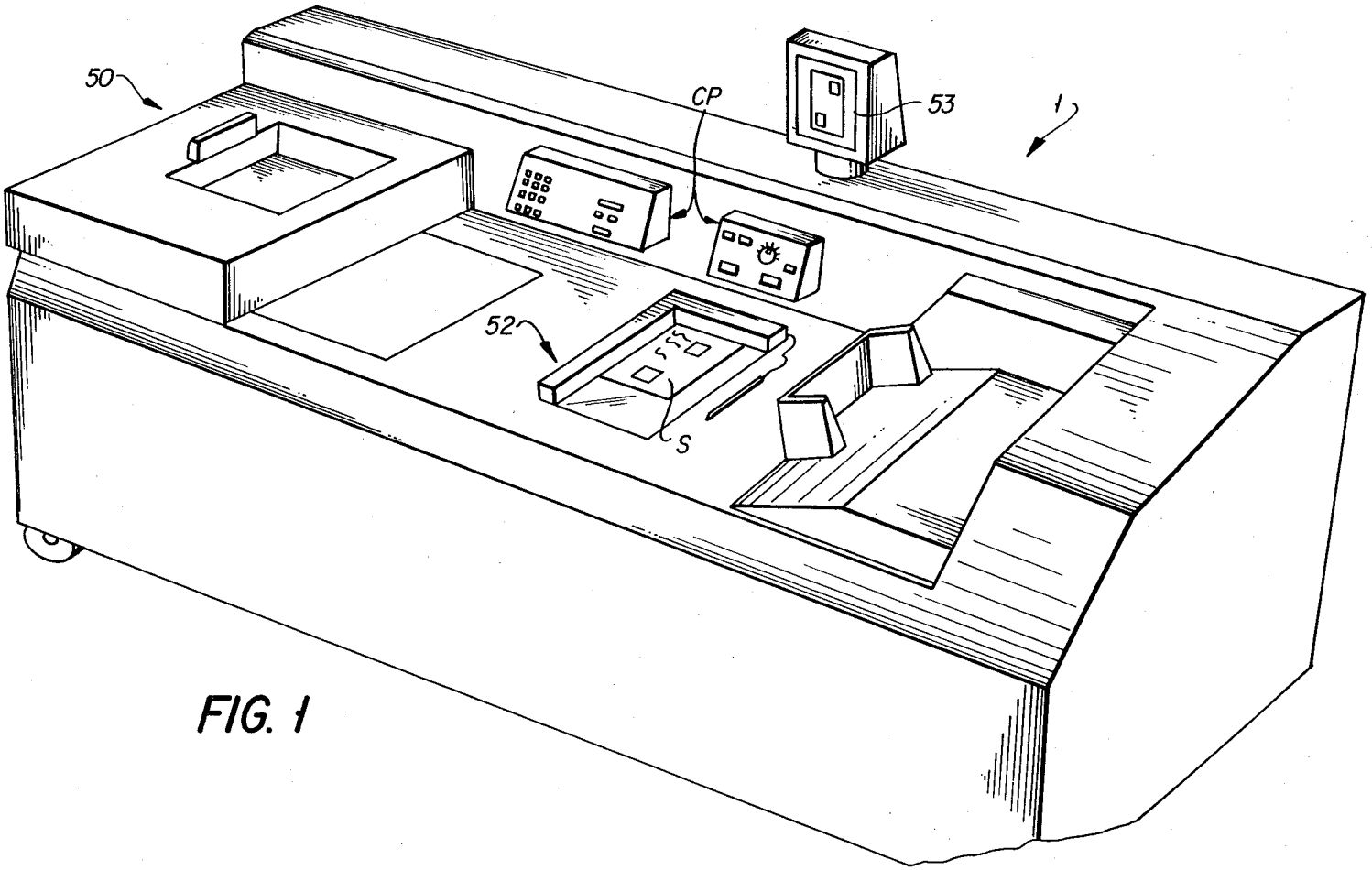
FIG. 1 is a perspective view of one embodiment of the electrophotographic apparatus for practice of the present invention.
Figure 2:
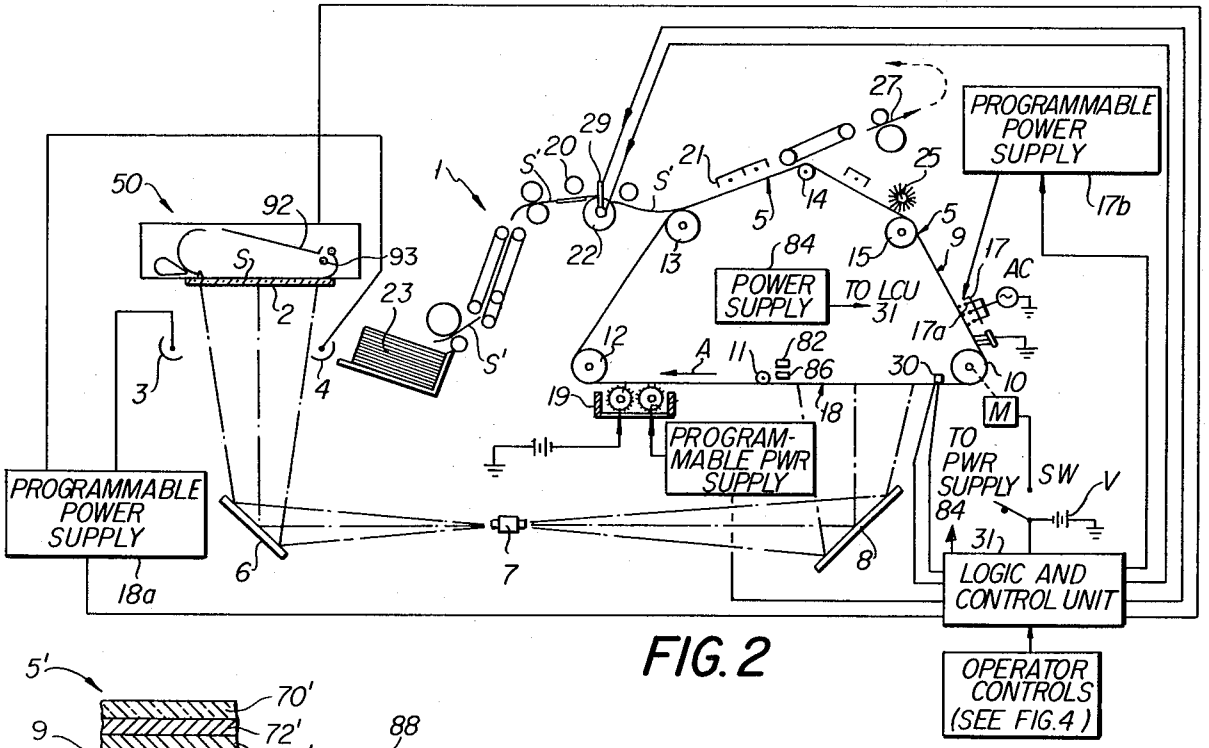
FIG. 2 is a schematic front elevational view of the apparatus of FIG. 1 and showing the general arrangement of electrophotographic reproduction apparatus that is in accordance with the invention.

With reference now to FIGS. 1 and 2, an electrophotographic reproduction apparatus 1 includes a photoconductive web 5 that is trained about six transport rollers 10, 11, 12, 13, 14 and 15, thereby forming an endless or continuous web. Roller 10 is coupled to a drive motor M in a conventional manner. Motor M is connected to a source of potential V when a switch SW is closed by a logic and control unit (LCU) 31. When the switch SW is closed, the roller 10 is driven by the motor M and moves the web 5 in clockwise direction as indicated by arrow A. This movement causes successive image area of the web 5 to sequentially pass a series of electrophotographic work stations of the copier.

For the purpose of the instant disclosure, several copier work stations are shown along the web's path. These stations will be briefly described.

First, a charging station 17 is provided at which the photoconductive surface 9 of the web 5 is sensitized by applying to such surface a uniform electrostatic primary charge of a predetermined voltage. The station 17 includes an A.C. corona charger shown as a three wire A.C. charger. The output of the charger is controlled by a grid 17*a* connected to a programmable power supply 17*b*. The supply 17*b* is in turn controlled by the LCU 31 to adjust the voltage level Vo applied onto the surface 9 by the charger 17.

At an exposure station 18, a light image of a document sheet S, supported on transparent platen 2, is projected by mirrors 6, 8 and lens 7 onto the photoconductive surface 9 of the web 5. While the apparatus will be described with respect to reflection exposure of the original document sheet onto the photoconductive surface, the use of transmission exposures of an original is also contemplated by the invention. The projected image dissipates the electrostatic charge at the light exposed areas of the photoconductive surface 9 and forms a latent electrostatic image. A programmable power supply 18*a*, under the supervision of the LCU 31, controls the intensity or duration of light from flash lamps 3 and 4 to adjust the exposure level E incident upon the web 5.

A development station 19 includes developer which may consist of iron carrier particles and electroscopic toner particles with an electrostatic charge opposite to that of the latent electrostatic image. Developer is brushed over the photoconductive surface 9 of the web 5 and toner particles adhere to the latent electrostatic image to form a visible toner particle, transferable image. The development station may be of the magnetic brush type with one or two rollers.

The apparatus 1 also includes a transfer station shown as a corona charger 21 at which the toner image on web 5 is transferred to a copy sheet S'; and a cleaning station 25, at which the photoconductive surface 9 of the web 5 is cleaned of any residual toner particles remaining after the toner images have been transferred. After the transfer of the unfixed toner images to a copy sheet S', such sheet is transported to a heated pressure roller fuser 27 where the image is fixed to the copy sheet S'.

As shown in FIG. 2, a copy sheet S' is fed from a supply 23 to continuously driven rollers 20, (only one of which is shown) which then urge the sheet against a rotating registration finger 29 of a copy sheet registration mechanism 22 and the sheet buckles. When the finger 29 rotates free of the sheet, the driving action of the rollers 20 and release of the sheet buckle cause the copy sheet to move forward onto the web 5 in alignment with a toner image at the transfer station 21.

To coordinate operation of the various work stations 17, 18, 19, 21, and 25 with movement of the image areas on the web 5 past these stations, the web has a plurality of perforations along one of its edges. These perforations generally are spaced equidistantly along the edge of the web 5. For example, the web 5 may be divided into six image areas by F perforations; and each image area may be subdivided into 51 sections by C perforations. The relationship of the F and C perforations to the image areas is disclosed in detail in commonly assigned U.S. Pat. No. 3,914,047, filed in the name of Hunt, Jr. et al and issued Oct. 21, 1975. At a fixed location along the path of web movement, there is provided suitable means 30 for sensing web perforations. This sensing produces input signals into the LCU 31 which has a digital computer, preferably a microprocessor. The microprocessor has a stored program responsive to the input signals for sequentially actuating then deactuating the work stations as well as for controlling the operation of many other machine functions as disclosed in U.S. Pat. No. 3,914,047. Additional encoding means may be provided as known in the art for providing more precise timing signals for control of the various functions of the apparatus 1.

Programming of a number of commercially available microprocessors such as an INTEL model 8086 microprocessor (which along with others can be used in accordance with the invention), is a conventional skill well understood in the art. This disclosure is written to enable a prorammer having ordinary skill in the art to produce an appropriate control program for the one or more microprocessors used in this apparatus. The particular details of any such program would, of course, depend on the architecture of the designated microprocessor.

Figure 4:
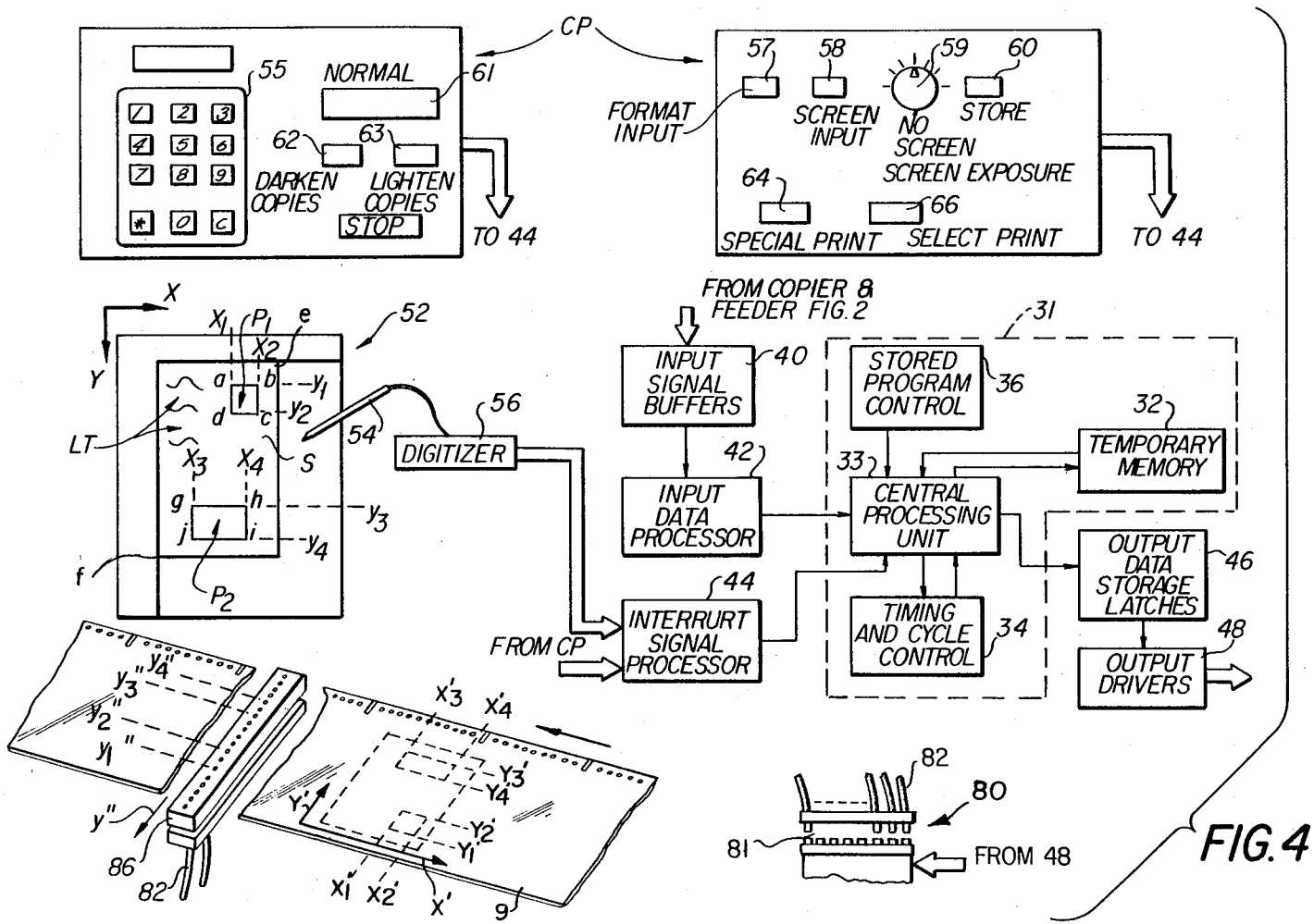
FIG. 4 is a schematic illustrating a data input station and block diagrams of controls for controlling the apparatus shown in FIG. 2.
Figure 5:
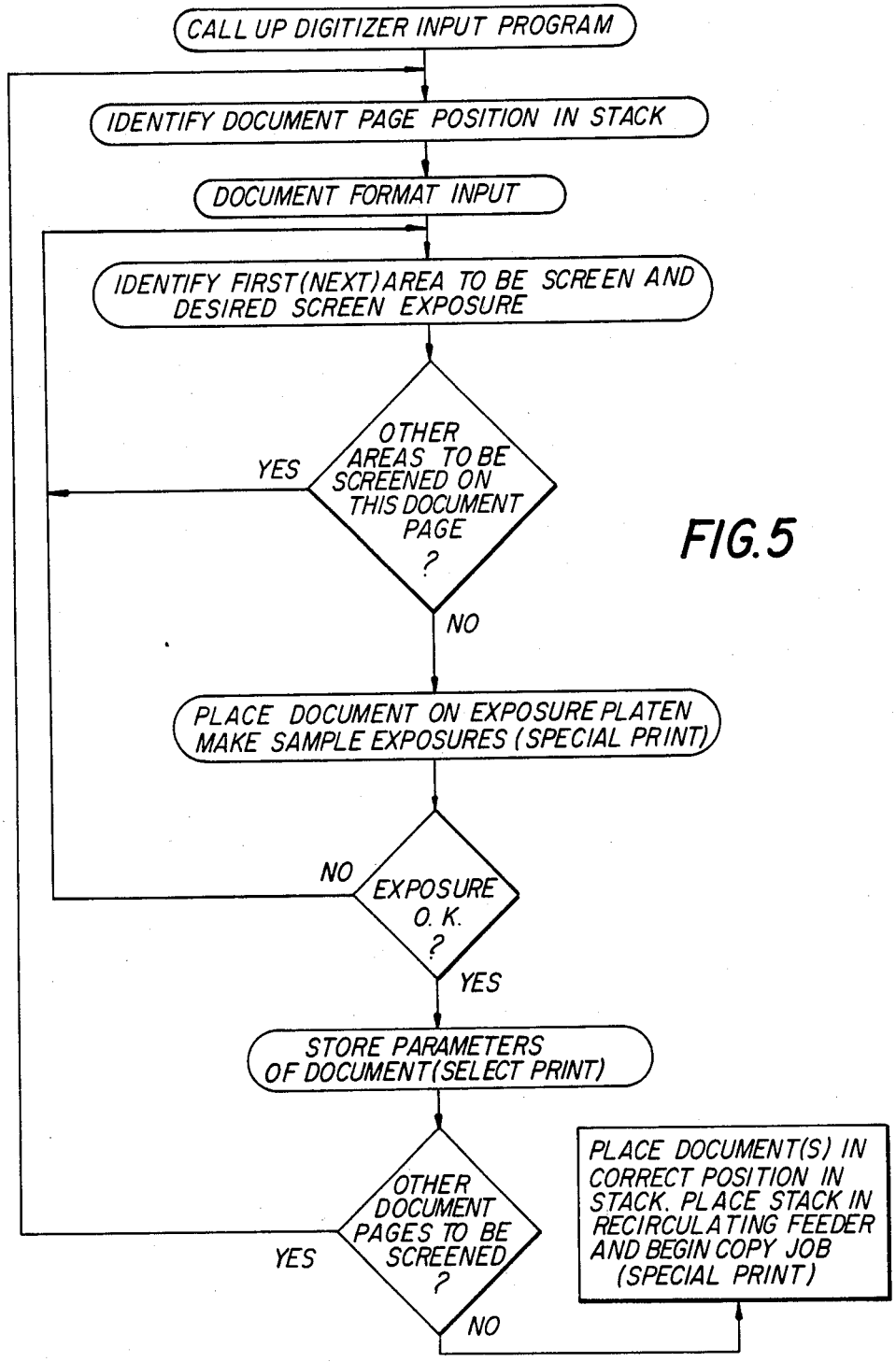
FIG. 5 is a flow chart indicating a series of steps used in the method of the present invention.

With reference also now to FIG. 4, a block diagram of logic and control unit (LCU) 31 is shown which interfaces with the apparatus 1 and a document feeding apparatus 50 that includes known recirculating feeder and document positioner means. Details of a known document feeding apparatus may be found, for example, in U.S. Pat. No. 4,451,137, issued May 29, 1984 in the name of Farley. Leads from feeding apparatus 50 provide inputs to and receive outputs from LCU 31 to synchronize the operation of the feeding apparatus. The LCU 31 consists of temporary data storage memory 32, central processing unit 33, timing and cycle control unit 34, and stored program control 36. Data input and output is performed sequentially under program control. Input data are supplied either through input signal buffers 40 to a input data processor 42 or to interrupt signal processor 44. The input signals are derived from various switches, sensors, and analog-to-digital converters. The output data and control signals are applied to storage latches 46 which provide inputs to suitable output drivers 48, directly coupled to leads. These leads are connected to the various work stations, mechanisms and controlled components associated with the apparatus. An electrical power supply 84 is provided to power the LCU 31.

Also shown in FIG. 4 is an operator control panel CP and a digitizing tablet 52 upon which is placed document sheet S. Document sheet S includes continuous tone pictorial information (or more generally—information to be reproduced with the selective screening process described herein) in areas $P_1$, $P_2$ thereof and line-type information LT (such as alphanumerics, or generally information not to be reproduced with the selective screening process described herein) in the background areas. A corner of the document sheet is registered in one corner of the digitizing tablet to establish a coordinate reference system for inputting information into temporary memory 32 regarding the location of the areas containing the continuous tone pictorial information. To enable the LCU 31 to receive this information, a keyboard 55 is provided on the operator control panel and connected to interrupt signal processor 44. The starred (*) button thereof is used in conjunction with a numerical code inputted by the operator through depression of particular numerical buttons on the keyboard. When the appropriate code is provided, a program stored in stored program control 36 is called up and through a CRT or other display 53 (FIG. 1) requests that the operator indicate with use of keyboard 55 the position of the sheet S in the document stack to be reproduced and also indicate with the use of a conventional wand 54 associated with the digitizing tablet the position relative to the registered corner of the document sheet of the continuous tone areas to be selectively screened. For the rectangular continuous tone pictorial area $P_1$ shown the wand may be used to touch the sheet at the four corner points of this area. Preferably the points are touched in an order such that a straight line joins adjacent points as in the order a,b,c, and d to define a rectangle. The computer control for the digitizing tablet may also be programmed to accept inputs of area data to define other geometrical shapes such as circles. Transducers locatedd beneath the sheet produce signals relating the position of the points touched relative to the registered upper right corner of the sheet. Alternatively, the tablet may be of the known sonic type wherein a spark formed by a want creates sound waves in the air which are sensed by microphones placed along the sides of the tablet or wherein a sensor is placed in the wand and sources at known points on the sides of the tablet emit sonic signals (see, for example, U.S. Pat. Nos. 4,012,588 in the name of Davis et al and 4,124,838 in the name of Kiss). A digitizer controller 56 knowing the times of emitting of the signals and their receipt can through triangulation principles calculate the location of a point on the platen relative to a known point such as the upper-left corner shown. The controller 56 for the digitizing tablet is programmed to recognize that the area is bordered by the straight lines joining adjacent points a, b, c and d and the coordinates for the area to be selectively screened can be thus calculated and communicated through interrupt signal processor 40 to be stored in temporary memory 32. This information is outputted on the display 53 showing the area to be screened. The coordinates for the points a, b, c and d would be $x_1$, $y_1$; $x_2$, $y_1$; $x_2$, $y_2$; and $x_1$, $y_2$, respectively. In order to display the appropriate size relationship between the area to be screened and the size of the document sheet, the computer control for the digitizer may be programmed to permit entry of data regarding document size, either through buttons pressed on the keyboard or by allowing the operator to input this information by touching corner points e and f on the digitizing tablet. Alternatively, where only one size document sheet original will be used with the apparatus, the size of the document sheet may be stored in the stored program control memory 36. Before use of the wand for each input, the operator will first identify the type of input by pressing the format input button 57 or screen input button 58. When introducing screen input information the operator will also adjust a screen exposure knob 59 which provides a means of adjusting the level of screen exposure for the particular area identified for screening. After the screen area is defined using the wand and the screen exposure level defined using the knob, the store button is pressed to retain this information in memory in conjunction with this particular document sheet as identified by its position in the document stack to be reproduced. Inputs from each of the buttons and knob provide digital level signals to the interrupt signal processor 44 for storage in the LCU's temporary memory 32.

As there is another continuous tone area to be reproduced the operator moves the wand over the points designating this area on the document sheet S, i.e., points g, h, i and j. The operator also adjusts the screen exposure knob 59 for this area to that which is desired and which need not be the same as indicated for areas a, b, c and d. this information is also stored and displayed on the display by pressing the store button 60.

The digitizing tablet is preferably so arranged that the edge or corner registered with the tablet is the same edge or corner which will be reproduced as the leading edge on the photoconductor. This is advantageous in that it will simplify calculation of the location of the area to be screened from the reference edge without the need for format input. In the example shown, the document is flipped over with the top edge at the bottom when located on the exposure platen 2 when being reproduced and thus the left edge of the document sheet S as shown in FIG. 4 will be reproduced as the lead edge on the photoconductor. Suitable logic or computing means may be provided on the digitizer or LCU 31 to translate the data points determined during the digitizing step for a plane or axes X, Y in the plane of the digitizing tablet to that of X', Y' on an image frame of the photoconductor's surface 9.

The operator next places the document sheet s on the exposure platen 2 with the document sheet appropriately registered such as with an edge suitably centered against a registration edge on the platen or with some copiers registered with a corner. Sample exposures can be made to determine through trian-and-error the desired exposure by making exposures using the NORMAL, DARKEN and LIGHTEN copy buttons, 61, 62 and 63, respectively, which control document exposure and contrast in a well known manner. Prior to making these test copies, a SPECIAL PRINT button 64 is depressed which signals the LCU to make the copies using the information inputted about the areas to be screened and the desired screen exposure. While the operator is using the digitizing tablet for inputting information about one job, the copier may be programmed so that it can be operated to produce copies for a different job.

Figure 3A:
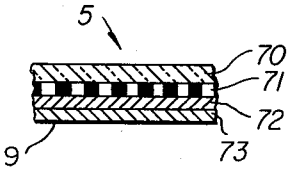
FIGS. 3*a* and 3*b* are schematic illustrations in cross-section of some of the elements forming a multi-layered photoconductive member for use in the apparatus of FIG. 2.

With reference now to FIG. 3*a*, it will be noted that the photoconductive web 5 comprises a transparent support 70, a halftone screen 71, a conductive layer 72, and a photoconductive layer 73. For a more complete description of the photoconductive web 5 and its screen, see U.S. Pat. No. 4,294,536, filed in the name of Paxton and issued Oct. 13, 1981.

As previously described, image exposure is effected by flash lamps 3 and 4, which form a latent electrostatic image of the document sheet on the web. Formation of a plurality of charge islands within the latent electrostatic image is effected by a second exposure through the rear of the web and through the integral halftone screen formed in the web. This rear exposure may be carried out prior to, simultaneous with, or after image exposure of the photoconductor, the only requirement being that this rear exposure be carried out after charging by charger 17 and prior to development.

With reference again to FIG. 4, there is shown a light source 80 for illuminating the screen from the rear of the web. The light source 80 comprises a plurality of light emitting diodes (LED's) 81. These LED's are coupled to the output drivers 48 of the LCU 31. Optical fibers 82 are associated with each of the LED's for directing light from the LED's to a conventional gradient index lens array (GRIN) 86, such as a SELFOC (trademark of Nippon Sheet Glass Co., Ltd.) array, located proximate the rear of the web and directed transverse to the direction of web movement. The GRIN 86 focuses the light from the output ends of the fibers onto the rear of the web. Alternatively, a linear array of LED's may be located proximate the web to expose the web either directly or through a GRIN array without the use of the optical fibers 82.

Prior to or as the frame on the photoconductive web upon which the image of the document sheet is to be formed passes beneath the GRIN, the LCU calculates which of the LED's to illuminate and the duration for such exposure. As shown in FIG. 4, the portions of the GRIN between the ordinates $y''_1$, $y''_2$ and $y''_3$, $y''_4$, respectively, on the Y'' axis of the linear GRIN correspond to their respective counterparts on the original document and to their respective ordinate counterparts $y'_1$, $y'_2$ and $y'_3$, $y'_4$ on the y' axis of the image frame. These ordinate pairs each define a transverse line past which a respective latent electrostatic continuous tone image area on the photoconductor will pass. When this continuous tone area begins to pass directly below (see FIG. 2) the GRIN 86, the appropriate LED's are illuminated by the LCU. The parameters for determining the timing of when to commence illumination and when to terminate illumination of the respective LED's are provided by the abscissa pairs $x'_1$, $x'_2$ and $x'_3$, $x'_4$, of the image frame respectively. Thus, when the portion of the image frame corresponding to the transverse line $x'_1$, as determined by signals provided by the LCU, underlies the linear GRIN array the LED's providing illumination between $y''_1$ and $y''_2$ commence to be illuminated. This illumination lasts until the transverse line $x'_2$ (also determined by the LCU) passes by the GRIN. A similar logical arrangement is provided for exposing the screen onto the area of the frame between the abscissas $x'_3$, $x'_4$ using illumination between points $y''_3$ and $y''_4$ on the GRIN.

It should be appreciated that in the use of LED's as an illumination source, it is not necessary that, during a period of their being illuminated for exposing the screen onto the charged photoconductive layer, the LED's be continuously illuminated. Rather each LED can have the respective electrical current thereto pulse-width modulated for a predetermined short period of time so in essence the illumination from each LED comprises a rapid series of flashes. The pulse width time or other parameter of each pulse for each LED can be individually tailored so that the LED's provide substantially equal light or a balanced output during each "flash." As the operator, by use of the screen exposure knob 59, has the ability to change the level of exposure of the screen by the LED's for a respective continuous tone area of the LCU can accomplish this by varying the pulse-widths for each LED accordingly or by altering other parameters such as the pulse repetition rate of the LED or changing the level of current to the LED above or below its predetermined balanced output level. Thus, a latent electrostatic image of the screen incorporated within the photoconductive web is imaged upon the charged web substantially only in the area of the image frame upon which the continuous tone image is to appear and, importantly, no screened exposure is provided where noncontinuous tone information is to be provided outside of this area.

As described above, the operator determines the desired overall exposure level for the document and for each of the areas to be screened. The parameters used for making the last test exposure may be assumed to be the desired exposure parameters for reproducing and selectively screening the document sheet. This data together with the position of document sheet S in a stack of document sheets to be reproduced can be stored in the LCU's temporary memory 32 by pressing the SELECT PRINT button 66. Alternative means may be provided for inputting the desired parameters without making a test copy to input this information through the interrupt signal processor 44 to store the settlings in temporary memory 32. Other document sheets that are to receive special exposure considerations are processed by the operator in a manner similar to that described for document sheet S. Thereafter, the document sheets are placed in their appropriate place in the stack and the stack placed on the tray 92 of recirculating feeder 50. Knob 59 is returned to its normal setting (normal for knob 59 being a "NO SCREEN" position) and the SPECIAL PRINT button 64 and NORMAL COPY button 61 are depressed. The feeder 90 feeds the document sheets one at a time to the exposure platen where they are appropriately registered. the document sheets for which no special instructions have been provided to the LCU are exposed and copied using normal exposure parameters and without illumination of the screen and returned to the top of the stack. The LCU 31 counts the number of document sheets delivered to the platen based on signals provided by a microswitch (not shown) positioned adjacent to feed rollers 93 located near the tray 92. When a document sheet passes this position, the switch is closed and applies a signal to the LCU. Further details of this feeder may be noted in U.S. Pat. No. 4,451,137 to Farley. When a document sheet, which is to receive special exposure and/or a screen exposure, is delivered to the platen, the exposure is accomplished using the data stored in temporary memory 32.

Figure 6:
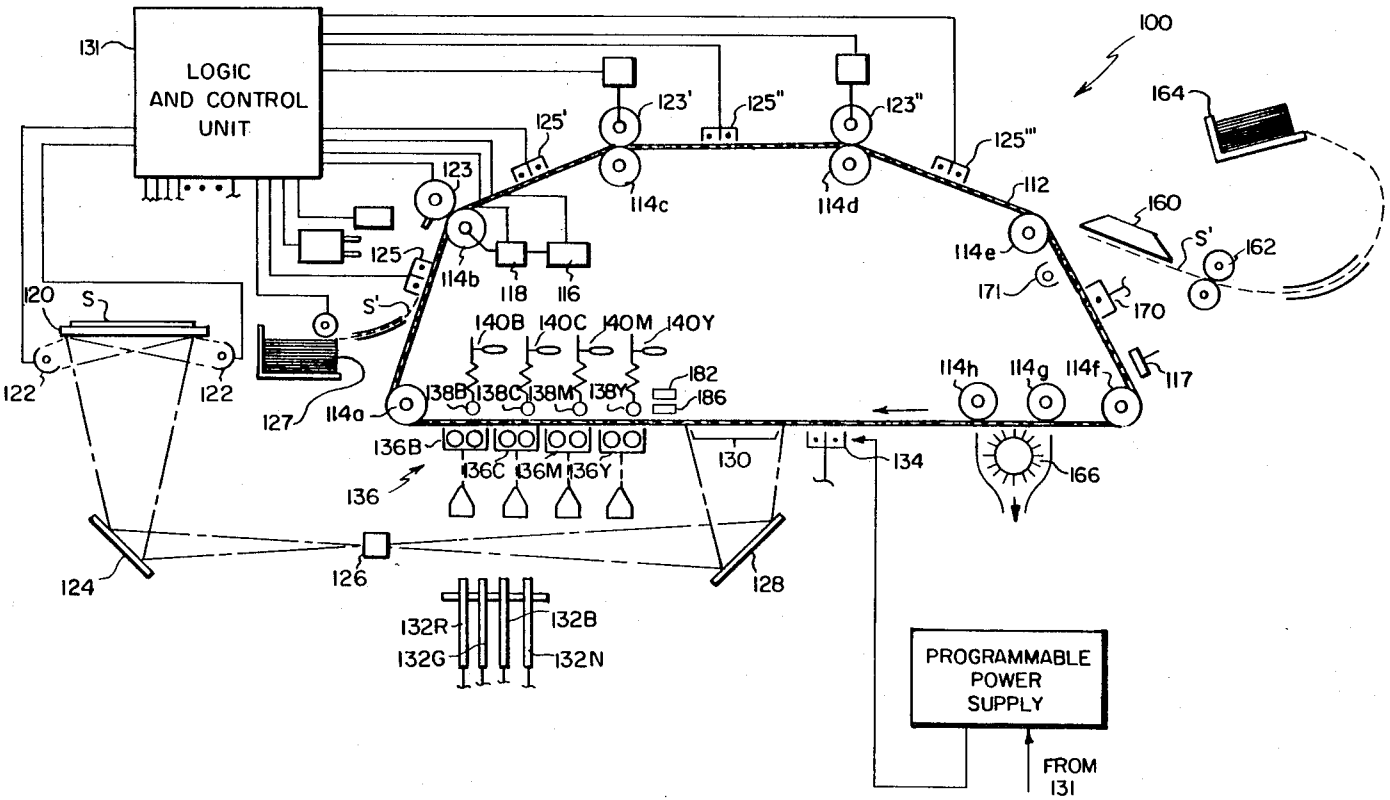
FIG. 6 is a schematic side view of the operating elements of a multicolor electrophotographic reproduction apparatus for practice of the present invention.

With reference now to FIG. 6, a four color multicolor electrophotographic reproduction apparatus is shown.

The apparatus 100 includes a closed loop, flexible image transfer member, or photoconductive web 112. The web 112, which may be of the type described in FIG. 3*a* is supported on rollers 114*a*–114*h*. The rollers are mounted on the copier frame (not shown) with one of the rollers, for example roller 114*b*, rotatively driven by a motor 116 to effect continuous movement of the web 112 in a clockwise direction about its closed loop path. The web has a plurality of sequentially spaced, non-overlapping image areas which pass successively through electrophotographic processing stations (charge, expose, develop, transfer, clean) located about the path of the web. The web also includes timing marks (or regularly spaced perforations) which are sensed by appropriate means, such as timing signal generator 117 to produce timing signals. Such signals are sent to a computer controlled logic and control unit 131. The LCU 131 controls the entire electrophotographic process based on the instantaneous location of the web in the travel path. An encoder 118 associated with the roller drive motor 116 also produces timing signals for the LCU. The signals from the encoder cause the LCU to fine tune the process timing. The LCU 131 has a digital computer, and preferably one or more microprocessors. The computer has a stored program responsive to the input signals for sequentially actuating, then de-actuating the work stations as well as for controlling the operation of many other machine functions.

A multicolored original document sheet S to be reproduced is placed, image side down, on a transparent glass platen 120 supported by the copier frame. Exposure lamps 122, such as xenon flash tubes, are located beneath the platen 120 within the frame. The lamps flood the document sheet with light and a reflected image of the document sheet is transmitted via mirror 124, lens 126, and mirror 128 in focus to an area 130 lying in the plane of the web 112. The original document could, of course, be a transparency illuminated from the back side thereof. The document sheet S is illuminated, for example, four times in succession to form four separate electrostatic latent images of the document. On successive illuminations a red filter 132R, a green filter 132G, or a blue filter 132B is inserted into the light path to form color separation images at the area 130. A fourth filter comprising a neutral density filter 132N for providing what is known as a skeletal black image is inserted during a fourth exposure of the original. The timing of the flash of lamps 122 and the insertion of the colored filters are controlled by the LCU and related to the travel of the web 112 to expose adjacent, nonoverlapping areas of the web to the color separation images and the skeletal black image. One or more corona charging units, exemplified by corona charger 134, is located upstream of the exposure area 130, and applies a uniform primary electrostatic charge, of say negative polarity, to the web 112 as it passes the charger and before it enters the exposure area. The photoconductive properties of the web cause the uniform charge in the exposed areas of the web to be discharged in that portion struck by the exposure light. This forms latent imagewise charge patterns on the web in the exposed areas corresponding to the respective black and color separation images. Travel of the web then brings the areas bearing the latent images into a development area 136. The development area has a plurality of magnetic brush development stations, corresponding to the number of formed black and color separation images, in juxtaposition to, but spaced from, the travel path of the web. When the color separation images are red, green and blue and a skeletal black image is also to be provided, there are four development stations respectively containing complementary colored toner particles, i.e., cyan particles in station 136C, magneta particles in station 136M, yellow particles in station 136Y, and black particles in station 136B. Backup rollers 138C, 138M, 138Y, and 138B, located on the opposite side of web 112 from the development area, are associated with respective developer stations 136C, 136M, 136Y and 136B. Actuators 140C, 140M, 140Y and 140B selectively move respective backup rollers into contact with the web 112 to deflect the web from its travel path into operative engagement with respective magnetic brushes. The charged toner particles of the engaged magnetic brush are attracted to the oppositely charged latent imagewise pattern to develop the pattern.

The logic and control unit 131 selectively activates the actuator in relation to the passage of the image areas containing corresponding latent color separation images through the development area 136. That is, as the area containing the latent red color separation image reaches the developement station 136C, actuator 140C moves the backup roller 138C to deflect the web so that the latent charge image is developed by attracting cyan toner particles from the station 136C. As soon as the image area leaves the effective development area of the station 136C, the actuator 140C returns the backup roller 138C to its nondeflecting position. Thus, as the areas containing the green and blue color separation images and the neutral density latent image pass the developer station 136C, no development takes place. A similar cycle is accomplished by the logic and control unit 131 for the developer stations 136M, 136Y and 136B. In this manner, the red latent color separation image is developed only with cyan toner particles, the green latent color separation image is developed only with magenta toner particles, the blue latent color separation image is developed only with yellow toner particles, and the neutral density latent image is developed only with black toner.

The developed black and color separation images must be transferred to a receiver sheet in accurately registered superimposed relation to form a full color reproduction of the original document. Apparatus for providing such registered transfer is fully described in U.S. Pat. No. 4,251,154, issued Feb. 17, 1981 in the name of Matthew J. Russel the contents of which are incorporated herein by this reference. Briefly, this is accomplished by feeding a receiver sheet S' from a supply 127 into engagement with the photoconductor 112 and in accurately registered superimposed relation with the first developed image frame. The superimposed receiver sheet and image frame pass beneath a transfer station that includes a corona charger 125 which charges the backside of the sheet and attracts the toner image to the receiver sheet. The receiver sheet is then stripped from the photoconductor by a rotating vacuum roller 123 which in accordance with signals from the LCU accurately registers the copy sheet in superimposed relationship with the next successive image frame on the photoconductor. This operation is repeated at successive transfer stations designated by prime superscripts until all four developed images are transferred to the receiver sheet.

After transfer of each of the four images to the receiver sheet, the receiver sheet is detacked from the web and moved along a path away from the web by a sheet transport apparatus such as, for example, a vacuum transport 160. The vacuum transport 160 delivers the sheet to a fixing apparatus, such as roller fuser 162. The transferred images are then fixed or fused onto the sheet and the sheet is then delivered to exit hopper 164. While the image is being fixed to the receiver sheet, the web 112 continues to travel about its path and proceeds through a cleaning area 166.

To facilitate toner removal from the web, a corona charging station 170 and a rear erase lamp 171 may be located upstream of the cleaning unit 166 to neutralize any charge remaining on the web and thus reduce the adherence forces of the toner to the web.

In order to reproduce a multicolor document sheet such as document sheet S having composite information comprised of line-type information LT and continuous-tone information, the document sheet S is placed face up on a digitizing tablet 52 and registered against an appropriate corner (or centered relative to a predetermined edge) as shown in FIGS. 1 and 4.

In a similar manner to that described above for the embodiment of FIGS. 1–4, the digitizing tablet is used to identify document size and location of the continuous tone areas relative to say a corner of the document sheet. This information is stored in the LCU 131 and used to illuminate selected LED's similar to that described and shown in FIG. 4 to illuminate a transverse linear GRIN array 186 via optical fibers 182 which convey illumination from the LED's to the GRIN array. In this multicolor embodiment, the LED's are used to image the screen on each of the four frames used to make the reproduction and only in the areas of each image frame upon which the continuous tone image is to appear. The integral screen photoconductor used may have the dot pattern that is printed therein rotated on adjacent frames so as to avoid moire patterns.

Thus, several embodiments of electrophotographic reproduction apparatus have been described having the ability to selectively screen only those portions of a copy sheet which reproduce images from continuous tone originals while other portions of the document sheet are not reproduced by exposure through a screen.

While the apparatus shown is adapted for making of simplex copies, a duplex type of electrophotographic reproduction apparatus may be provided for handling duplex originals and providing special exposure as described above for such originals.

While the invention has been described with regard to one type of array using an LED light source, it will be appreciated that others may be substituted. For example, laser, halogen or mercury light sources may be substituted for the LED's with variable aperture arrays such as mechanically moveable masks or alternatively electrically actuated masks such as PLZT arrays used to control screen illumination. PLZT is an abbreviation for a lead lanthanum zirconate titanate electro-optical material whose optical properties can be changed by an electric field. Programmable electroluminescent light panels which may be selectively illuminated may also be used and do not require a separate light source. Illuminating panels or aperture arrays need not be linear, but can be areal and cover the area of the frame so that as a respective frame of the photoconductive web underlies the panel array, illumination may be then selectively provided, as in a flash type exposure, of only the area of the screen that overlies the area of the photoconductor where the continuous tone information is or was imaged.

LED's providing light outputs that are substantially of green color may be used in combination with an integral screen in the photoconductive web that is of a complementary color (magenta) to make non-illuminated and therefore non-discharged patterns which can be developed as halftone patterns in the pictorial areas. Similarly, a red light emitting diode may be used with a screen that is formed of a cyan colored ink to provide the half tone spots or lines.

An interesting feature of some LED's emitting green colored light is that they are known (see U.S. Pat. No. 4,538,900 to Lutus et al, issued Sept. 3, 1985), when providing a different level of drive current thereto, to change spectral content such as to red. As indicated above, where a cyan colored ink is used for the halftone screen, the red colored light content of the LED's may be used to image a screen pattern on the electrostatic charge on the photoconductor in accordance with the requirements of the areas requiring selective screening. On the other hand whenever areas of the photoconductor are required to be substantially erased of charge such as areas in an image frame to be selectively erased or interframe and edge areas of the photoconductor the current level to the LED's may be adjusted to provide light outputs in the green color. Green color light is absorbed substantially less by the cyan dots compared with red colored light and thus the cyan colored screen is substantially transparent to light of green color. Control programs are known for illuminating a linear light source lying transverse to the direction of movement of a photoconductor for providing selective erase of charge from interframe and edge areas in accordance with encoded signals to the LCU determining the timing for illuminating a light source at say when the interframe area is positioned to be exposed to the light from the light source. An apparatus thus providing currents to selected LED's at levels suitable for generating light of a color to which the screen is transparent, for providing selective erase, and providing different currents to the LED's for generating light of a color to which the screen is not transparent, for providing selective screening, allows for the elimination of the need for an additional light source to provide the erase function.

The invention is not limited to the use of a photoconductor with an integral screen. The screen may be separate from the photoconductor and when it is so, may be positioned adjacent the surface of the photoconductor that is to be developed.

Figure 3B:
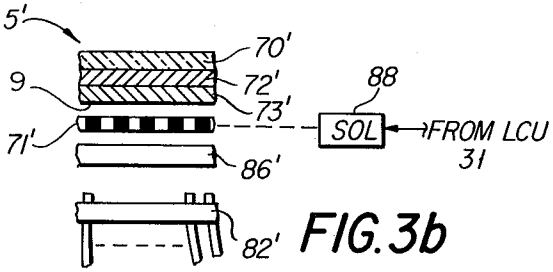

When the screen is separate from the photoconductor (see FIG. 3*b* wherein a prime (') is used to designate similar parts to that shown in FIG. 3*a* and FIG. 4) it may be moved into and out of position in accordance with the requirements of screening and selective erase. For example, when interframe areas are to be erased, the screen may be moved out of its blocking position or moved to a defocus position and the LED's illuminated to erase substantially all the charge in the interframe area. When an image frame is to be screened, either completely or selectively, the signals from the LCU 31 may be provided to, for example, rotate the screen into its exposure position (or blocking position) so that illumination from selected LED's exposes the screen at appropriate areas of the frame as described herein. A solenoid operated mechanism 88 well known in the art may be provided for moving the screen in and out of its exposure position in response to signals from the LCU 31.

As used herein, the term "interframe" relates to an area on the photoconductor surface between adjacent complete image frames.

While the method and apparatus of the invention have been illustrated in conjunction with an apparatus having a recirculating feeder, the invention in its broadest aspect contemplates apparatus and methods wherein a document may be copied by having the operator place it directly on the exposure platen. A digitizing tablet may be incorporated on or by the exposure platen itself. A cover for the exposure platen used to shield the operator from light from the exposure platen may also have incorporated therein a digitizing tablet. The document may be placed face-up on the underside of the platen cover and its format and areas of continuous tone information determined using the digitizer incorporated within the cover. As the cover is closed onto the platen, the document sheet held by the cover by vacuum or tackiness on the cover now is face down on the exposure platen and in position for exposure.

While the invention has been described with regard to a flash exposure of a document, other types of exposure are also contemplated. For example, the image may be scanned upon the electrostatically charged photoconductor and may be imaged thereon using either a scanning reflection or transmission exposure of the original or using light which has been electronically generated from say a bit stream. In the former segments of the original are scanned by a light source and the light modulated by the document is imaged upon the photoconductor. In the latter the information contents of a document are digitized into electrical signals by a suitable electronic image "reading" device and these signals used to modulate a light source such as a laser or LED array which are then imaged upon the photoconductor. The image for the screen itself would be imaged upon the photoconductor independently of the imaging source by the techniques described herein of selectively exposing a portion of the integral screen onto the photoconductor surface where the information is desired to be screened and not exposing the screen in areas of the frame where information is not desired to be screened. The advantage to this is in providing simpler controls to the laser or LED array that is used to expose the photoconductor with image information. While a separate light source for exposing the screen is suggested, it is also possible to use the same light source such as a laser in different modes to expose the screen pattern and the image pattern. For example, with the use of a rotating mirror, a laser beam can in one orientation of a mirror arrangement expose a screen pattern in the photoconductor from the "backside thereof" so that a charge pattern on the photoconductive surface is modulated with the screen pattern. This screen pattern may be selectively provided in certain portions of the image frame by the variable aperture arrays described above so that screening is only provided on areas used to reproduce continuous tone information. In a second orientation of the mirror, the laser can be used to expose the photoconductive surface directly with a signal modulated with image information of both the continuous tone and line-type information.

The invention in its broader aspects also contemplates a selective screening method and apparatus disclosed in application Ser. No. 809,550, entitled "Apparatus and Method for Electrophotographically Producing Copies From Originals Having Continuous Tone and Other Content," filed on Dec. 16, 1985 in the name of Michael D. Stoudt et al, the contents of which are incorporated herein. In that application, a method and apparatus are disclosed for reproducing a composite original document formed of a continuous tone information and line-type information by the steps of (a) forming a halftone pattern screen image on an entire image frame (b) imaging the entire document on the image frame (c) erasing selectively the areas of charge outside the continuous tone information areas via signals indicating the locations to be erased (d) imaging the entire document on a second image frame (e) erasing selectively the areas of charge representing the continuous tone information, and (f) transferring the two images in register onto the same surface of a copy sheet to form a reproduction. In order to form the halftone screen pattern on the one image frame, an integral screen photoconductor is used as described herein, however, a linear electroluminescent light panel is positioned proximate the web transverse to the direction of web travel. The panel would essentially take the place of the LED's 81, optical fibers 82 and GRIN 86. The electroluminescent panel when energized would be used to illuminate the screen pattern over an entire image frame. A linear LED array or GRIN array receiving light from selectively illuminated LED's may then be positioned facing the opposite surface of the web to selectively erase charge in accordance with signals provided via digitizing of the location of the continuous tone areas.

Figure 7:
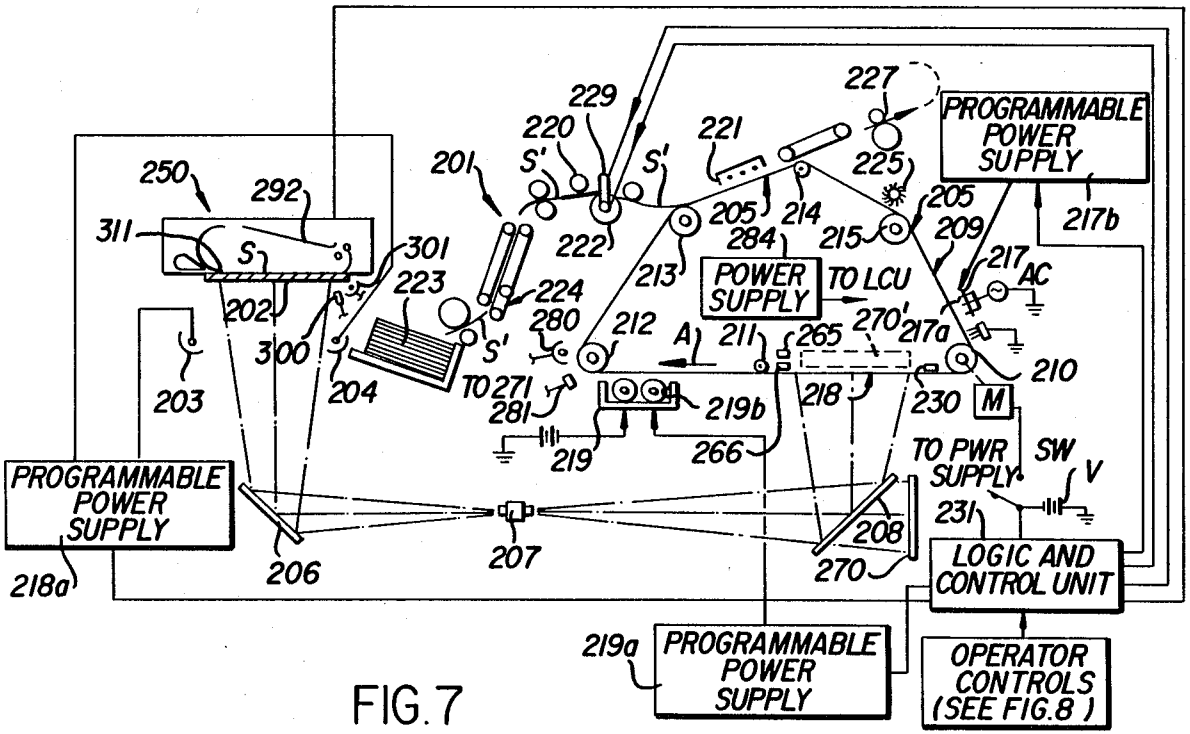
FIG. 7 is a schematic front elevational view of another embodiment of the electrophotographic reproduction apparatus for practice of the present invention.
Figure 8:
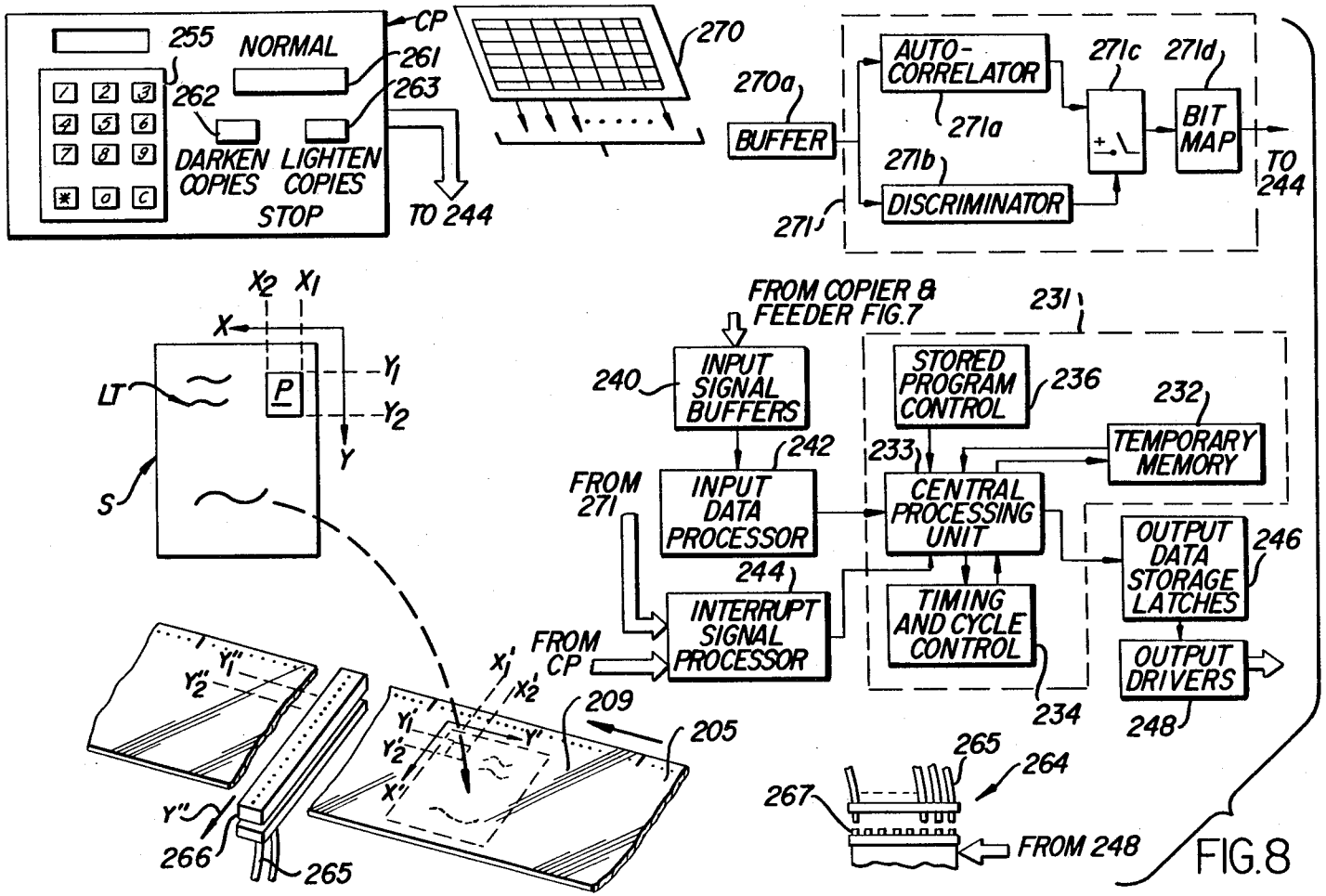
FIG. 8 is a schematic illustrating a data input station and block diagrams of controls for controlling the apparatus shown in FIG. 7.

The invention is also useful in an electrophotographic reproduction apparatus as illustrated in FIGS. 7–8. In the embodiment of the apparatus of FIGS. 7–8, a method and apparatus are disclosed for reproducing a composite original document formed of continuous tone information and line-type information wherein the contents of the original are scanned automatically to determine the location(s) of continuous tone areas on the original document.

With reference now to FIG. 7, an electrophotographic reproduction apparatus 201 includes a photoconductive web 205 that is trained about six transport rollers 210, 211, 212, 213, 214 and 215, thereby forming an endless or continuous web. Roller 210 is coupled to a drive motor M in a conventional manner. Motor M is connected to a source of potential V when a switch SW is closed by a logic and control unit (LCU) 231. When the switch SW is closed, the roller 210 is driven by the motor M and moves the web 205 in clockwise direction as indicated by arrow A. This movement causes successive image area of the web 205 to sequentially pass a series of electrophotographic work stations of the copier.

For the purpose of the instant disclosure, several copier work stations are shown along the web's path. These stations will be briefly described.

First, a charging station 217 is provided at which the photoconductive surface 209 of the web 205 is sensitized by applying to such surface a uniform electrostatic charge of a predetermined voltage. The station 217 includes an A.C. corona charger shown as a three wire A.C. charger. The output of the charger is controlled by a grid 217*a* connected to a programmable power supply 217*b*. The supply 217*b* is in turn controlled by the LCU 231 to adjust the primary voltage level Vo applied onto the surface 209 by the charger 17.

At an exposure station 218, a light image of a document sheet S, supported on transparent platen 202, is projected by mirrors 206, 208 and lens 207 onto the photoconductive surface 209 of the web 205. While the apparatus will be described with respect to reflection exposure of the original document sheet onto the photoconductive surface, the use of transmission exposures of an original is also contemplated by the invention. The projected image dissipates the electrostatic charge at the light exposed areas of the photoconductive surface 209 and forms a latent electrostatic image. A programmable power supply 218*a*, under the supervision of the LCU 231, controls the intensity or duration of light from lamps 203 and 204 to adjust the exposure level E incident upon the web 205.

A development station 219 includes developer which may consist of iron carrier particles and electroscopic toner particles with an electrostatic charge opposite to that of the latent electrostatic image. Developer is brushed over the photoconductive surface 209 of the web 205 and toner particles adhere to the latent electrostatic image to form a visible toner particle, transferable image. The development station may be of the magnetic brush type with one or two rollers.

The apparatus 201 also includes a transfer station shown as a corona charger 221 at which the toner image on web 205 is transferred to a copy sheet S'; and a cleaning station 225, at which the photoconductive surface 209 of the web 205 is cleaned of any residual toner particles remaining after the toner images have been transferred. After the transfer of the unfixed toner image to a copy sheet S', such sheet is transported to a heated pressure roller fuser 227 where the image is fixed to the copy sheet S'.

As shown in FIG. 7, a copy sheet S' is fed from a supply 223 to continuously driven rollers 220, (only one of which is shown) which then urge the sheet against a rotating registration finger 229 of a copy sheet registration mechanism 22 and the sheet buckles. When the finger 229 rotates free of the sheet, the driving action of the rollers 220 and release of the sheet buckle cause the copy sheet to move forward onto the web 205 in alignment with a toner image at the transfer station 221.

To coordinate operation of the various work stations 217, 218, 219, 221, and 225 with movement of the image areas on the web 205 past these stations, the web has a plurality of perforations along one of its edges. These perforations generally are spaced equidistantly along the edge of the web 205. For example, the web 205 may be divided into six image areas by F perforations; and each image area may be subdivided into 51 sections by C perforations. At a fixed location along the path of web movement, there is provided suitable encoder means 230 for sensing web perforations. This sensing produces input signals into the LCU 231 which as a digital computer, preferably a microprocessor. The microprocessor has a stored program responsive to the input signals for sequentially actuating then de-actuating the work stations as well as for controlling the operation of many other machine functions. Additional encoding means may be provided as known in the art for providing more precise timing signals for control of the various functions of the apparatus 201.

With reference also now to FIG. 8, a block diagram of logic and control unit (LCU) 231 is shown which interfaces with the apparatus 201 and a document feeding apparatus 250 that includes known recirculating feeder and document positioner means. Leads from feeding apparatus 250 provide inputs to and receive outputs from LCU 231 to synchronize the operation of the feeding apparatus. The LCU 231 consists of temporary data storage memory 232, central processing unit 233, timing and cycle control unit 234, and stored program control 236. Data input and output is performed sequentially under program control. Input data are applied either through input signal buffers 240 to a input data processor 242 or to interrupt signal processor 244. The input signals are derived from various switches, sensors, and analog-to-digital converters. The output data and control signals are applied to storage latches 246 which provide inputs to suitable output drivers 248, directly coupled to leads. These leads are connected to the various work stations, mechanisms and controlled components associated with the apparatus. An electrical power supply 284 is provided to power the LCU 231.

With reference again to FIG. 7, it will be noted that mirror 208 is a beam splitter which allows a portion of the image of the document sheet to be imaged upon a full frame image sensor 270 which may be a vidicon camera or more preferably a CCD image sensor. The document sheet S, when located face down on the platen 202, has an edge centered or a corner registered along a corresponding registration edge or corner of the platen. The image of the document as sensed by sensor 270 thus will have a registered relationship to the document and the image exposed upon an image frame area of the photoconductor. In content, the original document sheet S may be composed of continuous tone images, low or high frequency halftone images and/or line-type such as alphanumeric information, etc. A continuous tone image comprises an unscreened image, typically a photograph. The signals from the portion of the sensor 270 which detects this type of image correspond to voltage values of pixels representative of the grey levels making up the picture. A halftone image, typically a picture or scene, is one which has been reproduced through a screening process. Halftone images comprise patterns of discrete dots. A stream of signals corresponding to the image pixels is fed out of the sensor 270 to a buffer 270*a*. The image signals may then be fed serially to an image processor 271 (see FIG. 8). Image processor 271 examines the pixel signals on a block by-block basis wherein each block comprises one or more pixels. The image processor may comprise an autocorrelator 271*a* that is capable of distinguishing high frequency halftone information from other types of information. A discriminator 271*b* is also provided for discriminating between line-type and low frequency screened half-tone information on the one hand and continuous tone information on the other. The outputs of the autocorrelator and discriminator are used to set a switch 271*c* or logic device which provides a signal for storage in a bit map 271*d* that identifies the pixel under consideration as being part of an area of either continuous tone information or other type of information (line-type or screened information). Image processors for distinguishing between this type of information are well known and disclosed for example in U.S. Pat. No. 4,194,221 to Stoffel, issued Mar. 18, 1980, the contents of which are incorporated herein. The locations of the bits of continuous tone information and non-continuous tone information are thus stored in the bit map in image processor 271. The bit map need not store the grey scale value of signal information, but only the factor that the information at a particular location in the bit map is of continuous tone information or non-continuous tone information. This information is fed to interrupt signal processor 244 associated with LCU 231. The LCU is programmed by stored program control 236 to enable a bank of light-emitting diodes (LED's) for illuminating the screen from the rear of the photoconductive web illustrated in FIG. 3*a*, as will be described.

As previously described, image exposure is effected by flash lamps 203 and 204, which forms a latent electrostatic image of the document sheet on the web. Formation of a plurality of charge islands within the latent electrostatic image is effected by a second exposure through the rear of the web and through the integral halftone screen formed in the web. This rear exposure may be carried out prior to, simultaneous with, or after image exposure of the photoconductor, the only requirement being that this rear exposure be carried out after charging by charger 217 and prior to development. As the data in the bit map is determined using light from the exposure source 203, 204, the LED bank can only be located before the exposure station when a preflash (preliminary flash) from sources 203, 204 is used to illuminate the document. Since it is known to use such a preflash to expose a preceding frame to clean adjacent interframe areas on a photoconductor, this preflash may also be used to provide the image exposure information to be read by the image sensor 270. The advantage of using this preflash is that extra time is provided for the image signal processor to process the data to determine the areas of the next image frame on the photoconductor that are to be selectively screened for the first exposure of that document sheet. Succeeding exposures of the same document sheet for producing additional copies need not be preflashed for interframe erase, nor is there a need for the image sensor 270 to be operative. It would thus be advantageous to logically couple the image sensor to the control logic establishing a preflash so that the sensor is turned on or is operative for the reading of the preflash, but is turned off during exposure of subsequent image frames which are to be developed.

With reference now to FIG. 8, there is shown a light source for illuminating the screen from the rear of the web. The light source may comprise a plurality of light emitting diodes 267 (LED's). These LED's are coupled to the output drivers 248 of the LCU 231. Optical fibers 265 are associated with each of the LED's for directing light from the LED's to a conventional gradient index lens array (GRIN) 266, such as a SELFOC (trademark of Nippon Sheet Glass Co., Ltd.) array, located proximate the rear of the web which focuses the light onto the rear of the web. The GRIN extends across the full width of web 205.

Prior to or as the frame on the photoconductive web upon which the image of the document sheet is to be formed passes across the GRIN array the LCU calculates which of the LED's to illuminate (based upon information stored in the bit map) and the duration for such exposure. As shown in FIG. 8, the continuous tone image area P is defined between the ordinate lines $y_1$, $y_2$ on the Y-axis of the platen (or original document sheet) and the abscissa lines $x_1$, $x_2$ on the x-axis of the platen. On the photoconductor frame exposed to the document sheet there are the corresponding ordinate lines $y'_1$, $y'_2$ and abscissa lines $x'_1$, $x'_2$, which define an area corresponding to the portion of the image frame receiving the image of the continuous tone image area. The position of these lines are "known" or calculatable based upon a registered relationship between the frame and the reference on the exposure platen. Corresponding LED's are associated with the ordinate lines $y'_1$, $y'_2$ and are adapted to illuminate respective portions of the output of the GRIN array between ordinates $y''_1$, $y''_2$ thereon. Illumination of the LED's will be during the time period beginning with the movement of abscissa line $x'_1$ past the GRIN array and will terminate with movement of abscissa line $x'_2$ past the GRIN array. The timing for this is determined by the LCU in accordance with signals from the apparatus' encoding means. The determination of which LED's to illuminate being made by the LCU in accordance with the continuous tone image area sensed by the sensor 270. Where multiple areas of continuous tone image information are present on the original the appropriate LED's for illuminating the screen at the appropriate times will be made in accordance with the teachings described above. Thus, a latent electrostatic image of the screen incorporated within the photoconductive web is imaged upon the charged web substantially only in the area of the image frame upon which the continuous tone image is to appear and, importantly, no screened exposure is provided where non-continuous tone information is to be provided outside of this area.

With reference again to FIG. 7, a modification of the apparatus is illustrated in dotted lines by elements numbered 280, 281. In the discussion of the apparatus indicated above, it was noted that either a preflash or mainflash of the document was used to provide image information on the document for sensor 270. Where a preflash is used on the apparatus described above, the apparatus may be programmed to either develop or not develop the image on the frame exposed to the light from the preflash. This may be controlled by controlling a programmable power supply 219*a* to a development roller 219*b* in development station 219. Where this image is developed but not transferred to a copy sheet (but eventually cleaned prior to the next exposure of this frame), the developed image may be used to determine the image characteristics of the original document. In this regard, a light source 280 and image sensor 281 are provided to respectively illuminate the developed image and read on a line-by-line basis the image characteristics of the developed image and hence the document. The advantage of using the developed image of a preflash illumination of a document is that the image sensor 281 need only be sensing one line at a time rather than the full frame sensor required for sensor 270. Another advantage is that the light source for illuminating the developed image may be matched to, and be the one most suited for, the sensor being used rather than being suited to the exposure operation. The data sensed by sensor 281 can be buffered and sent to image processor 271 which distinguishes between the input signals representing continuous tone areas and the input signals which are attributable to half-tone or line-type information. The operation of the selective screening process is similar to that described above.

Other modifications may include the placement of a light source and sensor proximate a document recirculating feeder 250 which advances a document from a stack that is supported on a tray 292. As the documents are advanced one at a time by rollers 293 against a registration edge 311 on the platen 202 the linear sensor 300 may read the image information from the document as illuminated by lamp 301 as the document sheet is moved toward registration edge 311. The image information would be processed as described above to provide selective screening of the reproduction.

Still other modifications may include the provision for the ability to adjust the level of screen exposure by providing controls for increasing or decreasing illumination from the LED's. Preferably the LED's are balanced initially so that illumination from each is uniform. This may be done by adjusting the respective current to each or by pulse width modulating the respective "on time" of each LED so they provide the same exposure. To provide for variation in level of screen exposure, means may be provided for either increasing or decreasing current from a nominal level to each of the LED's or by adjusting their respective "on times."

The invention is not limited to the use of a photoconductor with an integral screen. The screen may be separate from the photoconductor and when it is so, may be positioned just downstream of the exposure station adjacent the surface of the photoconductor that is to be developed. Where the screen is separate from the photoconductor, a sensor such as sensor 270' (shown in phantom) may be positioned behind the photoconductor (above as viewed in FIG. 7) at the exposure station to "read" the original exposure through the photoconductor web and have selective screening be performed downstream of the exposure station by an exposure source that illuminates a halftone pattern upon the photoconductor at locations on the image frame wherein a latent electrostatic image of the continuous tone image on the original document sheet is formed.

While the description of the embodiment of FIGS. 7 and 8 is with regard to a one color station copier the invention is also useful in a multicolor electrophotographic reproduction apparatus such as described for FIG. 6.

Thus, an electrophotographic reproduction apparatus has been described having the ability to automatically selectively screen only those portions of a copy sheet which are to reproduce images from continuous tone originals.

The invention is also useful in the apparatus and method described in U.S. application Ser. No. 809,547, filed on Dec. 16, 1985 in the name of Matthew J. Russel and entitled Automatic Spot Color Copying Apparatus and Method. In that application, a method and apparatus are disclosed for reproducing a composite original document wherein the contents of the original are scanned automatically and continuous tone areas distinguished from other areas by the use of fluorescent highlighting ink placed over or around the information on the original document sheet to be specially treated. A reading device sensitive to the highlighting can be used to distinguish areas of highlighting from those of other areas and thereby detect those areas of continuous tone information. The highlighting ink used is of a color to which the reproduction apparatus is otherwise not responsive to and thus is considered transparent by the reproduction apparatus.

Still other modifications include providing of a low intensity screen exposure to the line-type information and a higher intensity screen exposure to areas used to reproduce the continuous tone information. This may be accomplished by either programming of the light source providiing the screen exposure or providing a separate light source to provide the entire image frame with a low; i.e. small, exposure of the screen pattern, and then have the programmable light source provide a selectively higher exposure of the screen pattern on areas reproducing the continuous tone image pattern.

Figure 9:
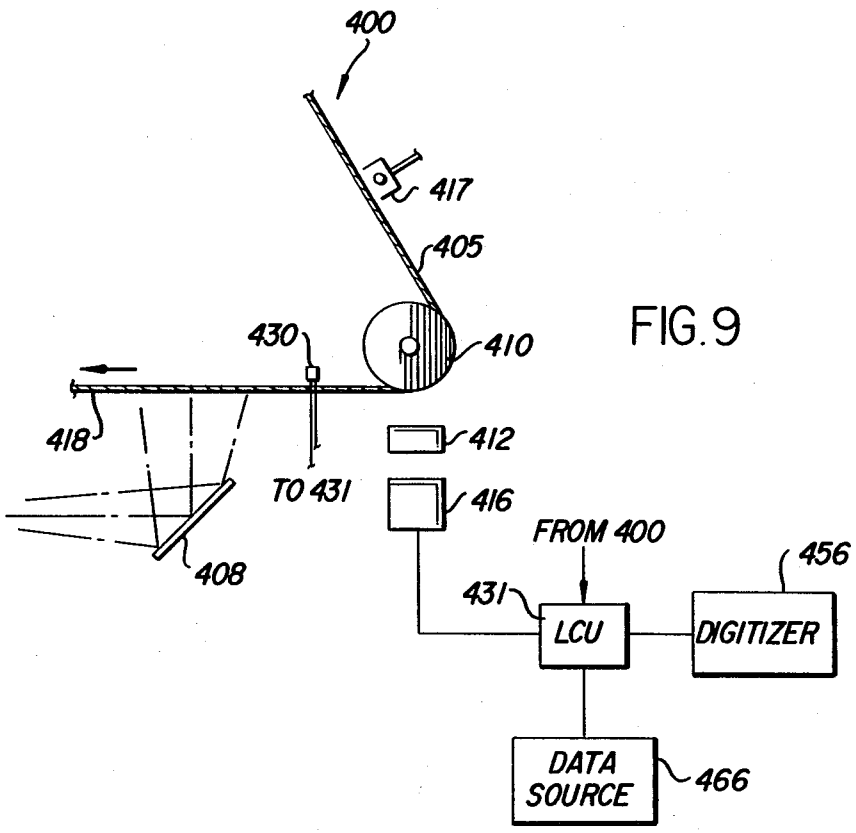
FIG. 9 is a schematic front elevational view of a portion of another embodiment of electrophotographic reproduction apparatus for practice of the present invention.

With reference to FIG. 9, a further modification is shown. In this figure a portion of an electrophotographic reproduction apparatus 400 is shown that is similar with that illustrated in FIG. 2 except that the screen has been omitted from the photoconductive web 405 and the portions of the LED imaging means 82 and 86 have been repositioned so as to now be located on the same side of the web which receives the optical exposure of the original document at exposure station 418 via mirror 408. In this embodiment a linear LED bar 416 is used and the image of the LED's focused onto the photoconductive web 409 by a GRIN array after the web has received a uniform primary electrostatic charge from primary corona charger 417. As in the embodiment of FIG. 2 a digitizing device 456 may be employed to enable the operator to select areas of the original document that are to be selectively screened. The digitizing function may be done automatically as described above for the embodiment of FIGS. 7 and 8. After the image frame upon which the document is to be reproduced is charged by the primary charger 417 selected LED's in the linear LED array 416 are enabled or driven by commands from the logic and control unit (LCU) 431 to form a series of charge islands in the particular area or areas of the image frame that are to be selectively screened. Assume, for example, that the LED array used has 150 LED's to the inch (59 per centimeter) and these LED's are arranged as a line directed perpendicular to the direction of web travel indicated by the arrow. To form the screen pattern the appropriate LED's are illuminated commencing at a time when the area to be screened passes over the LED array. The LED's, in this example, will each be pulsed 150 times for each inch (59 per centimeter) of travel of the web. The movement of the web is monitored by one or more encoders 430 which generates signals regarding web movement and feeds these signals to the LCU 431. The LCU may contain a program to control the pulsing frequency of each LED with rate of movement of the web. If the drive to the photoconductive member is considered to be reasonably uniform over the length of the image area to be screened the need for an encoder to time each line for firing of the LED's may be dispensed with. In such a case the LED's will still be considered to be enabled in accordance with movement of the web. The duration of each pulse will be that appropriate for simulating a screen pattern on the selected area. In this regard the light from the LED's will erase charge where they expose the web and will leave charge islands, simulating the screen pattern, in the interstitial areas between exposed pixels. After the exposure of the portion(s) of the image frame to be screened by the LED array the optical exposure of the original document on the platen is made in timed relationship to movement of the photoconductor and the image of the continuous tone pictorial information superimposed with that of the screened pattern. Subsequently the entire image frame, containing say both line type information and the screened pictorial information, has its latent electrostatic image developed and transferred to a receiver sheet or support as described for the embodiment of FIGS. 1–4. An advantage to the use of this modification is that the LED array may now also be used as a writer of information; i.e. a non-impact printer, assuming that a data source 466, such as a computer with raster image processor are provided. The LED array may thus be used to write information onto areas of the image frame suitably masked from the optical exposure, or erase undesired areas so as to have them not reproduce, or selectively screen areas as described above. While the location of the LED arrays is shown before the optical exposure station it may also be located after this station and before development. Modifications and features heretofore described with regard to the other embodiments may also where feasible be used with this embodiment.

The invention has been described in detail with particular reference to preferred embodiments thereof, but it will be understood that variations and modifications can be effected within the spirit and scope of the invention.

We claim:

1. In a method for electrophotographically reproducing an original document sheet having a continuous tone image on an area portion thereof wherein the image is to be reproduced as a halftone reproduction, the method including the steps of supporting the original document sheet at an exposure station, illuminating the original document sheet, imaging light reflected from or transmitted through the original document sheet onto a photoconductive member to form a developable electrostatic latent image of the document on an area of the photoconductive member; and the improvement which comprises:

(a) providing signals related to the position of the continuous tone image area relative to a reference element; and (b) forming in response to said signals an electrostatic latent halftone pattern image on the portion of the area of the photoconductive member which is to form the reproduction of the continuous tone image area.

2. The method according to claim 1 wherein the original document sheet also includes areas of line-type information and wherein a developable electrostatic latent image of this type of information is recorded on the photoconductive member on areas thereof not modulated by an electrostatic halftone pattern image.

3. The method according to claim 2 and including the step of developing the developable electrostatic latent images using opaque electroscopic toner and transferring the images to a copy sheet to provide on the copy sheet a halftone screened reproduction of the continuous tone image and a reproduction of the line-type information that is not modulated with a halftone pattern.

4. The method according to claim 3 and including the step of providing and storing signals related to the position of the original document sheet in a multi-sheet document stack, reproducing the multi-sheet document by moving serially the sheets of the multi-sheet document from a stack to an exposure platen, and then to a stack, counting the number of documents moved to the exposure platen and reproducing the aforesaid original document sheet in response to said count and the stored signals relating the position of the original document sheet in the stack.

5. The method according to claim 3 and wherein the photoconductive member is moved in a predetermined direction and the latent halftone pattern image is formed in step (b) by illuminating a source of illumination, independent of imaging light reflected from or transmitted through the original document sheet, through a halftone screen.

6. The method according to claim 5 and wherein the original document sheet includes more than one area of continuous tone images whose images are to be reproduced on different areas of the photoconductive member and including the step of selectively varying the exposures of the halftone pattern images by said source of illumination to provide different exposures of the latent halftone patterns formed on the areas of the photoconductive member.

7. The method according to claim 5 and including the step (c) wherein the source of illumination is activated to provide illumination of a spectral content that is substantially transparent to the halftone screen to substantially erase charge from a selected area of the photoconductive member to provide substantially no developable halftone pattern image in said selected area and wherein in step (b) the source of illumination is activated to provide illumination of a substantially different spectral content from that in step (c).

8. The method according to claim 7 and wherein the selected area is an interframe area on the photoconductive member.

9. The method according to claim 5 and wherein the halftone screen is movable between its position in step (b) to another position where it does not block illumination from the source of illumination and including the step (c) of providing signals related to the position of a different area on the photoconductive member that is to be erased of charge so as to form substantially no developable halftone image pattern in said different area and (d) maintaining the screen in said another position while illuminating the source of illumination to erase charge from the different area so as to form substantially no developable halftone image pattern in said different area.

10. The method according to claim 9 and wherein the different area is an interframe area on the photoconductive member.

11. The method according to claim 1 wherein the photoconductive member is moved in a predetermined direction and the latent halftone pattern image is formed in step (b) by illuminating a source of illumination, independent of imaging light reflected from or transmitted through the original document sheet, through a halftone screen.

12. The method according to claim 11 and including the step of (c) wherein the source of illumination is activated to provide illumination of a spectral content that is substantially transparent to the halftone screen to substantially erase charge from a selected area of the photoconductive member to provide substantially no developable halftone pattern image in said selected area and wherein in step (b) the source of illumination is activated to provide illumination of a substantially different spectral content from that in step (c).

13. The method according to claim 12 wherein the selected area is an interframe area on the photoconductive member.

14. In a method for electrophotographically reproducing an original document sheet having a continuous tone pictorial image information content on an area thereof and image information content of another kind that is of non-continuous tone such as line-type information, the method including the steps of (a) exposing a photoconductive member having an electrostatiac charge thereon to light modulated with information of the original document sheet to form a developable latent electrostatic image of the information on the document sheet, (b) separately exposing the photoconductive member to light modulated by a halftone screen pattern before, during or subsequent to said first exposing step to form a screened latent electrostatic image of the halftone screen pattern only in those areas of the photoconductive member which comprise reproductions of continuous tone information found in the original document, (c) developing the latent electrostatic image, and (d) transferring the developed image to a copy sheet.

15. In an electrophotographic reproduction apparatus for reproducing an original document sheet having a continuous tone image on a portion thereof wherein the image is to be reproduced as a halftone reproduction, the apparatus including means for supporting the original document sheet at an exposure station, means including a photoconductive member for forming a developable electrostatic latent image when subjected to imaging radiation from the original document sheet; means for illuminating the original document sheet and for imaging light from the original document sheet onto an area of the photoconductive member; and the improvement which comprises:

first means providing signals related to the position of the continuous tone image area relative to a reference element on the original document sheet; and programmable second means responsive to said signals for forming a developable electrostatic latent halftone pattern image on the portion of the area of the photoconductive member which is to form the reproduction of the continuous tone image area.

16. The apparatus according to claim 15 and including means for providing and storing signals related to the position of the original document sheet in a multi-sheet document stack, means for moving serially the sheets of the multi-sheet document to an exposure platen from a stack to an exposure platen and then to a stack, means for counting the number of documents moved to the exposure platen, and means for reproducing the aforesaid original document sheet in response to said count and the stored signals relating to the position of the original document sheet in the stack.

17. The apparatus according to claim 15 and wherein the original document sheet includes more than one area of continuous tone images whose images are to be reproduced on different areas of the photoconductive member and the programmable means includes means for selectively varying the exposures of the halftone pattern images on the photoconductive member to provide different exposure os the latent halftone patterns formed on the areas of the photoconductive member.

18. The apparatus according to claim 17 and wherein the means for selectively varying the exposures of the halftone pattern images comprises illumination means independent of the means for illuminating the original document sheet.

19. The apparatus according to claim 18 and including means for moving the photoconductive member in a predetermined direction and wherein the illumination means comprises a group of light emitting points arranged transversely to the direction of movement of the member; and wherein the programmable means selectively illuminates the photoconductive member in response to said signals.

20. The apparatus according to claim 19 and wherein the photoconductive member includes a halftone screen integral therewith.

21. The apparatus according to claim 15 and including means for moving the photoconductive member in a predetermined direction and the programmable means includes illumination means for illuminating a halftone pattern on the portion of the photoconductive member which is to form the reproduction of the continuous tone image area, the illumination means comprising a group of light emitting points arranged transversely to the direction of movement of the photoconductive member; and the programmable means selectively illuminates the photoconductive member in response to said signals.

22. The apparatus according to claim 21 and wherein the photoconductive member includes a halftone screen integral therewith.

23. The apparatus according to claim 21 and wherein the first means comprises a digitizing tablet.

24. The apparatus according to claim 19 and wherein the first means comprises a digitizing tablet.

25. The apparatus according to claim 15 and wherein the first means comprises a digitizing tablet.

26. The apparatus according to claims 15, 18, or 27 and including means for moving the photoconductive member in a predetermined direction and the programmable means includes point source exposing means for generating a simulated latent halftone pattern image without light from said point source exposing means passing through a screen.

27. The apparatus according to claim 26 and wherein the point source means exposing means comprises a series of light emitting point sources capable of forming a series of uniformly spaced exposed pixel areas that lie along a line transverse to the direction of the photoconductive member's movement and the programmable means modulates the point sources with a frequency related to the member's movement and the aforesaid spacing between pixel areas.

28. The method according to any one of claims 1, 2, 3, 4, 14 or 24 and wherein the latent halftone pattern image is formed by exposing the photoconductive member to a selected point light source(s) to form a simulated latent halftone pattern image without light from said point light sources passing through a screen pattern.

29. The method of claim 28 and wherein the frequency of light output(s) is modulated in accordance with the member's movement.

30. In a method for making electrophotographic reproductions, the method including the steps of providing from a first source light modulated with image information onto an electrostatically charged photoconductive member to form a developable electrostatic latent image of the image information on an area of the photoconductive member; and the improvement which comprises:

(a) providing signals related to the position of an image area to be screened relative to a reference element; and (b) forming in response to said signals an electrostatic latent halftone pattern image using a source independent of the first source on the portion of the area of the photoconductive member which is to form the reproduction of the image information to be screened.

31. The method according to claim 30 wherein the reproduction also includes areas of information that are not to be screened during the method of reproduction and wherein a developable electrostatic latent image of this type of information is recorded on the photoconductive member on areas thereof not modulated by an electrostatic halftone pattern image.

32. The method according to claim 31 and including the step of developing the developable electrostatic latent images using opaque electrostatic toner and transferring the images to a copy sheet to provide on the copy sheet a halftone screen reproduction of the information to be screened and a reproduction of information that is not modulated with a halftone pattern during the method of reproduction.

33. The method according to claim 31 and wherein the photoconductive member includes an integral halftone screen pattern and the latent halftone pattern image is formed in step (b) by illuminating a source of illumination, independent of imaging light reflected from or transmitted through the original document sheet, through the halftone screen.

34. In an apparatus for making electrophotographic reproductions from an electrostatically charged photoconductive member for forming a developable electrostatic latent image when subjected to imaging radiation; first means for exposing an area of the photoconductive member with light modulated with image information; and the improvement which comprises:

means providing signals related to the position of an image area to be screened relative to a reference element; and second means independent of the first means and responsive to said signals for forming a developable electrostatic latent halftone pattern image on the portion of the area of the photoconductive member which is to form the reproduction of the image information.

35. The apparatus according to claim 34 and including means for moving the photoconductive member in a predetermined direction and the second means includes point source exposing means for generating a simulated latent halftone pattern image without light from said point source exposing means passing through a screen.

36. The apparatus according to claim 35 and wherein the point source means exposing means comprises a series of light emitting point sources capable of forming a series of uniformly spaced exposed pixel areas that lie along a line transverse to the direction of the photoconductive member's movement and the programmable means modulates the point sources with a frequency related to the member's movement and the aforesaid spacing between pixel areas.

37. In a method for electrophotographically reproducing an original document sheet having a multicolor continuous tone image on an area portion thereof within the image is to be reproduced as a halftone reproduction, the method including the steps of supporting the original document sheet at an exposure station, repeatedly illuminating the original document sheet, imaging light reflected from or transmitted through the original documet sheet onto a photoconductive member to form a plurality of developable electrostatic latent color-separation images of the document sheet on different image frames of the photoconductive member; and the improvement which comprises:

(a) providing signals related to the position of the continuous tone image area relative to a reference element on the original document sheet; and (b) forming in response to said signals electrostatic latent halftone-pattern color separation images on the portions of the image frames which are to form the reproductions of the continuous tone image area.

38. The method according to claim 37 wherein the original document sheet also includes areas of line-type information and wherein developable electrostatic latent images of this type of information are recorded on the image frames on areas thereof not modulated by an electrostatic halftone pattern image.

39. The method according to claim 38 and including the step of developing the developable electrostatic latent images using opaque electrostatic toners of different colors and transferring the images to a copy sheet to provide on the copy sheet a multicolor halftone screened reproduction of the continuous tone image and a reproduction of the line-type information that is not modulated with a halftone pattern.

40. The method according to claim 37 and wherein the photoconductive member is moved in a predetermined direction and the latent halftone pattern images are formed in step (b) by illuminating a source of illumination, independent of imaging light reflected from or transmitted through the original document sheet, through a halftone screen.

41. The method according to claim 40 and wherein the original document sheet includes more than one are of continuous tone images whose images are to be reproduced on different areas of an image frame and including the step of selectively varying the exposures of the halftone pattern images by said source of illumination to provide different exposures of the latent halftone patterns formed on the image frame.

42. The method according to claim 37 and wherein in step (a) the document sheet is automatically scanned to determine the relative position(s) of areas of continuous tone information on the document sheet.

43. In a method for making electrophotograhic reproductions, the method including the steps of (a) exposing a plurality of image frames of a photoconductive member having a electrostatic charge thereon to image forming illumination to form a plurality of developable latent color separation electrostatic images of the information to be reproduced which includes information that is to be reproduced with a screen pattern and information that is not to be reproduced with a screen pattern, (b) separately exposing at least some of the same image frames to light modulated by a halftone screen pattern before, during or subsequent to said first exposing step to form a screened latent electrostatic images of the halftone screen pattern only in those areas of each image frame which are to reproduce the information that is to be reproduced with the screen pattern; and (c) developing the latent electrostatic images using toners of different colors and (d) transferring the developed images to a copy sheet.

44. In a method for electrophotographically reproducing an original document having a continuous tone image on an area thereof, wherein the image is to be reproduced as a halftone reproduction, the method including the steps of supporting the original document at an exposure station, illuminating the original document, imaging light reflected from or transmitted through the original document onto a photoconductive member to form a developable electrostatic latent image of the document on a predetermined area of the photoconductive member; developing the developable image and the improvement which comprises:

automatically sensing the relative position(s) of areas of continuous tone information on the document and generating signals relative thereto; and forming in response to said signals an electrostatic latent halftone pattern image on the portion(s) of the predetermined area(s) which is (are) to form the reproduction(s) of the continuous tone image area(s).

45. The method according to claim 44 wherein the original document sheet includes areas of line-type or alphanumeric information and wherein a developable electrostatic latent image of this type of information is recorded on the photoconductive member on areas thereof not modulated by an electrostatic halftone screen pattern image.

46. The method according to claim 45 and including the step of developing the developable electrostatic latent images using opaque electrostatic toner and transferring the images to a copy sheet to provide on the copy sheet a reproduction having a halftone reproduction of an image and a reproduction of line-type or alphanumeric information that has not been modulated with a halftone screen pattern image.

47. In a method for electrophotographically reproducing an original document sheet having both a continuous tone image information content on an area thereof and image information content of another kind that is of non-continuous tone such as line-type information, the method including the steps of:

a. illuminating the original document sheet;

b. exposing a photoconductive member having a uniform electrostatic charge thereon to light reflected from or transmitted through the original document sheet to form a developable latent electrostatic image of the information on the document sheet;

c. exposing the photoconductive member to light modulated by a halftone screen pattern before, during or subsequent to said first exposing step to form a screened latent electrostatic image of the information on the document sheet;

d. developing the latent electrostatic image, and e. transferring the developed image to a copy sheet, the improvement which comprises:

the step of automatically sensing the relative position(s) of areas of continuous tone information, on the document sheet and generating signals relative thereto and wherein in step c., the electrostatic latent image is formed, in response to said signals, with a halftone screen pattern only in those areas which comprise reproductions of continuous tone information found in the original document sheet.

48. In an electrophotographic reproduction apparatus for reproducing an original document sheet having a continuous tone image on an area thereof wherein the image is to be reproduced as a halftone reproduction, the apparatus including means for supporting the original document sheet at an exposure station, means including a photoconductive member for forming a developable electrostatic latent image when subjected to imaging radiation from the original document sheet; means for illuminating the original document sheet and for imaging light from the original document sheet onto a predetermined area of the photoconductive member to form the developable image; means for developing the developable image and the improvement which comprises:

means for automatically sensing the relative positions of areas of continuous tone information on the document sheet and for generating signals relative thereto;

means responsive to said signals for forming a developable electrostatic latent halftone pattern image on the portion of the predetermined area which is to form the reproduction of the continuous tone image area.

49. The apparatus of claim 48 and wherein the sensing means comprises image sensing means for sensing illumination from the original document sheet.

50. The apparatus of claim 49 and wherein the apparatus includes means for illuminating the document sheet with a preflash prior to illuminating the document sheet with a mainflash and wherein the apparatus further includes means for developing a latent electrostatic image formed on the photoconductive member with the mainflash and not developing a latent electrostatic image formed on the photoconductive member with the preflash; and wherein the sensing means senses the preflash illumination from the original document sheet.

51. The apparatus of claim 49 and wherein the automatic sensing means senses imaging illumination from the original document sheet that passes through the photoconductive member.

52. The apparatus of claim 48 and wherein the automatic sensing means senses the document sheet as it is being moved into the exposure station.

53. The apparatus of claim 48 and wherein the apparatus includes means for illuminating the document sheet with a preflash prior to illuminating the document sheet with a mainflash and wherein the apparatus further includes means for developing separate latent electrostatic images of the document sheet formed on the photoconductive member with the preflash and mainflash; and wherein the sensing means senses the developed image on the photoconductive member when sensing the relative position(s) of areas of continuous tone information on the developed image made using the preflash.

* * * * *